US005829453A

United States Patent [19]

White et al.

[11] Patent Number: 5,829,453

[45] Date of Patent: Nov. 3, 1998

[54] LOW-DENSITY TOBACCO FILLER AND A METHOD OF MAKING LOW-DENSITY TOBACCO FILLER AND SMOKING ARTICLES THEREFROM

[75] Inventors: Jackie Lee White, Pfafftown; Barry Lynn Saintsing, Lexington; Thomas Albert Perfetti, Winston-Salem; Curtis Dillard McGee, Jr., Germanton; Milly Mee Lee Wong, Winston-Salem, all of N.C.

[73] Assignee: R. J. Reynolds Tobacco Company, Winston-Salem, N.C.

[21] Appl. No.: 489,199

[22] Filed: Jun. 9, 1995

[51] Int. Cl.[6] ..... A24B 15/00

[52] U.S. Cl. ..... 131/359; 131/369; 131/310; 131/375; 131/364; 131/78

[58] Field of Search ..... 131/359, 375, 131/78, 364, 369, 310

[56] References Cited

U.S. PATENT DOCUMENTS

| | | | |
|---|---|---|---|
| 3,203,432 | 8/1965 | Green et al. . | |
| 3,223,090 | 12/1965 | Strubel et al. . | |
| 3,411,515 | 11/1968 | Hind et al. | 131/353 |
| 3,964,496 | 6/1976 | White | 131/359 |
| 3,964,497 | 6/1976 | White | 131/355 |
| 4,058,129 | 11/1977 | Beringer et al. . | |
| 4,347,855 | 9/1982 | Lanzillotti et al. . | |
| 4,391,285 | 7/1983 | Burnett et al. . | |
| 4,510,950 | 4/1985 | Keritsis et al. . | |
| 4,513,756 | 4/1985 | Pittman et al. . | |
| 4,534,372 | 8/1985 | White . | |
| 4,625,737 | 12/1986 | Keritsis et al. . | |
| 4,632,131 | 12/1986 | Burnett et al. . | |
| 4,770,194 | 9/1988 | Ohashi et al. . | |
| 4,819,667 | 4/1989 | Dvazic | 131/310 |
| 4,823,817 | 4/1989 | Luke . | |
| 4,836,224 | 6/1989 | Lawson et al. . | |
| 4,880,018 | 11/1989 | Graves, Jr. et al. . | |
| 4,977,908 | 12/1990 | Luke . | |
| 4,989,620 | 2/1991 | Keritsis et al. . | |
| 5,003,995 | 4/1991 | Kersey . | |
| 5,060,663 | 10/1991 | Rainer . | |
| 5,072,744 | 12/1991 | Luke et al. . | |
| 5,120,559 | 6/1992 | Rizvi et al. . | |

*Primary Examiner*—Vincent Millin
*Assistant Examiner*—Charles W. Anderson

[57] ABSTRACT

A low-density filler material for cigarettes from either a low-density tobacco composition or an extruded grain or starch composition. The low-density tobacco composition and a method of making the low-density tobacco composition by extruding a mixture of tobacco and flour or tobacco and starch under conditions whereby the solvent in the extruded mixture flashes into vapor upon release from the extrusion head. The low-density tobacco composition is formed without the aid of an added binder. The low-density flour or starch material and a method of making it by extruding flour or starch with a filler material such as calcium carbonate under conditions whereby the solvent in the extruded mixture flashes into vapor upon extrusion through the orifice die. The extruded composition can then be cut and used in place of cut tobacco filler.

16 Claims, 3 Drawing Sheets

LOW-DENSITY TOBACCO FILLER AND A METHOD OF MAKING LOW-DENSITY TOBACCO FILLER AND SMOKING ARTICLES THEREFROM

FIELD OF THE INVENTION

The present invention relates to the manufacture of smokeable material and, in particular, to a method of making a low density, extruded tobacco filler, the low density filler and smokeable article made with the low density filler.

BACKGROUND OF THE INVENTION

Low density filler material has been of interest to cigarette manufacturers because it provides a way of reclaiming and using tobacco dust and other scrap tobacco in the manufacture of cigarettes. The low density filler material displaces an equal volume of higher density cut tobacco filler thus resulting in a lower "tar" and nicotine cigarette. Low density cigarette filler material has usually been of two different types, namely, an extruded mixture of tobacco dust, starch and a binder or a roasted grain.

Cured tobacco leaf usually undergoes several processing steps prior to the time the resulting cut filler is used to make cigarettes. The normal sequence is to separate the stem from the laminae of the cured tobacco leaf. The tobacco laminae undergoes further processing steps finally resulting in cut filler and the stems are either discarded or employed in the manufacture of reclaimed tobacco products. The storing, handling, cutting, blending and transporting stages of conventional cigarette making results in the formulation of a considerable amount of wasted tobacco material in the form of dust and fines. This cigarette dust and fines (C-dust) is of such small size as to be useless as cut filler for cigarettes. However, it is possible to retrieve C-dust and fines and employ this material either with tobacco stems or alone in the manufacture of reclaimed or reconstituted tobacco. The use of C-dust or C-dust and stems has also been suggested for use in extruded tobacco products.

The extrusion of tobacco particles, starch and a binder has been previously described in the patent literature. For example, in U.S. Pat. No. 4,823,817, the use of cellulose binders, such as hydroxyethyl cellulose, methyl cellulose, ethyl cellulose and hydroxypropyl cellulose, with starch and tobacco is disclosed. In U.S. Pat. No. 4,880,018, galactomannans, such as locust bean gum and tara gum, and mixtures of galactomannans with carrageens and xanthan gum as binders with tobacco particles and optional filler material are disclosed.

According to the extrusion process of the aforementioned U.S. Pat. No. 4,823,817, starch, tobacco offal and binder are dry mixed, then fed into the hopper of a twin screw extruder. Sufficient water is fed into-the barrel of the extruder to moisten the mixture of tobacco, starch and binder. The mixture is then extruded at a pressure sufficient to keep the water in the liquid phase and at a sufficiently high temperature so as to gelatinize the starch. As the extrudate issues from the die, the water flashes into steam, thereby expanding the extrudate and forming a closed cell extrudate structure. The extruded material is then cooled and drawn down by counter-rotating rollers to form a sheet. The sheet is then slit into filaments which are used as a substitute for cut filler.

SUMMARY AND OBJECTS OF THE INVENTION

The present invention relates to a low density tobacco filler composition, a method of making a low density tobacco filler composition and a smokeable article made from the composition. There are two approaches to the low density tobacco filler of the invention. In the first approach, the expanded extruded tobacco composition is produced by the following steps:

1. Dry mixing rice flour or starch with tobacco, e.g., C-dust, and, optionally, a filler such as sodium or calcium carbonate, carbon or activated carbon;

2. Feeding the dry mixture to the feed port of an extruder;

3. Injecting sufficient water into the extruder to moisten the mixture of tobacco and rice flour or starch; and 4. Extruding the binderless mixture of rice flour or starch and tobacco (and optionally a filler) at sufficient pressure and temperature so that the water present will flash into steam, thereby expanding the extruded tobacco/rice flour or tobacco/starch mixture.

The expanded extruded tobacco/rice flour or tobacco/starch composition is solid and lightweight with a pleasing tobacco odor. The expanded extruded tobacco/rice flour or tobacco/starch composition is collected and employed in the manufacture of cut filler and smoking articles such as cigarettes.

It was discovered that the degree of expansion of the composition was dependent on the size of the die orifice of the extruder at constant temperature and pressure of the extruded material at the die orifice. The larger the die orifice at constant temperature and pressure, the greater the expansion of the extruded material.

It was unexpectedly discovered according to the invention that a binderless mixture of tobacco particles, e.g., C-dust and rice flour yielded an expanded extruded tobacco product with improved properties as discussed hereinafter in more detail. Even more unexpected was the discovery that starch could be substituted for the rice or grain flour without the use of a binding agent in the extrusion process and that an extruded mixture of tobacco and starch without a binder also resulted in an acceptable extrudate.

The invention allows the reclaiming of C-dust, tobacco fines and tobacco leaf stem or a mixture of C-dust and stems in an efficient and effective manner to yield a low density extruded tobacco composition. Advantageously, no additional binders are needed to bind the extruded product together. The extruded tobacco/grain flour composition is especially useful as a cigarette filler material because of its low density. The composition displaces an equal volumetric amount of cut filler resulting in a lower tar and nicotine cigarette with substantially the same level of smoking satisfaction.

The second approach is to extrude a tobaccoless mixture of rice flour or rice starch with an optional filler such as calcium carbonate. The extruded mixture can then either be coated with C-dust or toasted to give an acceptable color similar to dried tobacco. This extruded rice flour or rice starch, after coating or toasting, is usable as a substitute for tobacco in a low tar and nicotine cigarette.

An object of the invention is to provide a low density extruded substitute for cut filler tobacco in the manufacture of cigarettes.

Another object of the invention is to provide a binderless, low density, extruded tobacco product useful as a substitute for cut filler.

Another object of the invention is to provide a binderless, low density, extruded tobacco product with the properties, including a lack of friability, necessary for the extruded tobacco product to be shredded into a cut filler tobacco product acceptable in the manufacture of cigarettes.

Still another object of the invention is to provide a binderless, low density extruded tobacco product that, when mixed with cut filler, can be made into an acceptable, smokeable cigarette.

A still further objective of the invention is to provide a binderless, low density extruded tobacco product with cut tobacco to make an acceptable, smokeable, low tar and nicotine cigarette.

A still further objective of the invention is to provide a binderless, low density extruded tobaccoless product that can be mixed with cut tobacco filler to make an acceptable, smokeable, low tar and nicotine cigarette.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
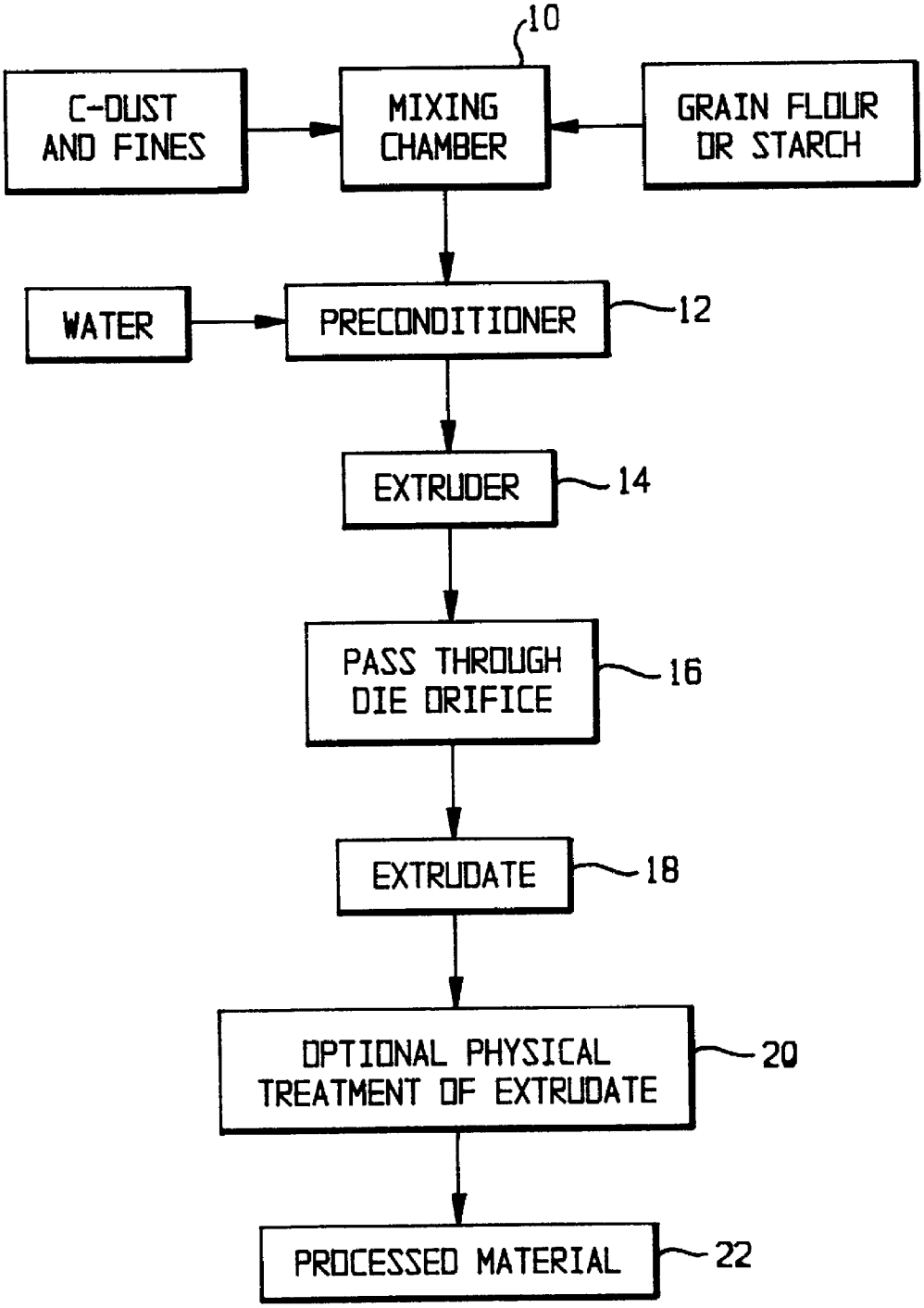
FIG. 1 is a schematic diagram of the preferred embodiments of the processing steps of the present invention.

Referring to the processing step diagram of FIG. 1, tobacco C-dust and fines are mixed with grain flour or starch and optionally with a filler material such as calcium carbonate in a mixing chamber 10 before being transported to a preconditioner 12, which may be a Wenger DDC Preconditioner described in U.S. Pat. No. 4,752,139. The mixture is fed into the extruder from the preconditioner and at the extruder inlet, sufficient water is injected at about 40 psig or less to moisten the mixture. The extruder 14 can be fitted with a jacket so that the mixture within the extruder can be heated or cooled. In the case of extruding a mixture of tobacco and flour, the extruder can be cooled to prevent damage to the extruder and/or tobacco/flour mixture. The tobacco/flour mixture is kneaded into a dough by the action of the extruder and extruded through a die orifice 16 at about 1150 to 5750 kPa. As the tobacco/flour extrudate passes through the die orifice, the temperature and pressure of the extrudate is such that the water flashes into steam, thereby expanding the extrudate 18 into a closed cellular structure.

Figure 2:
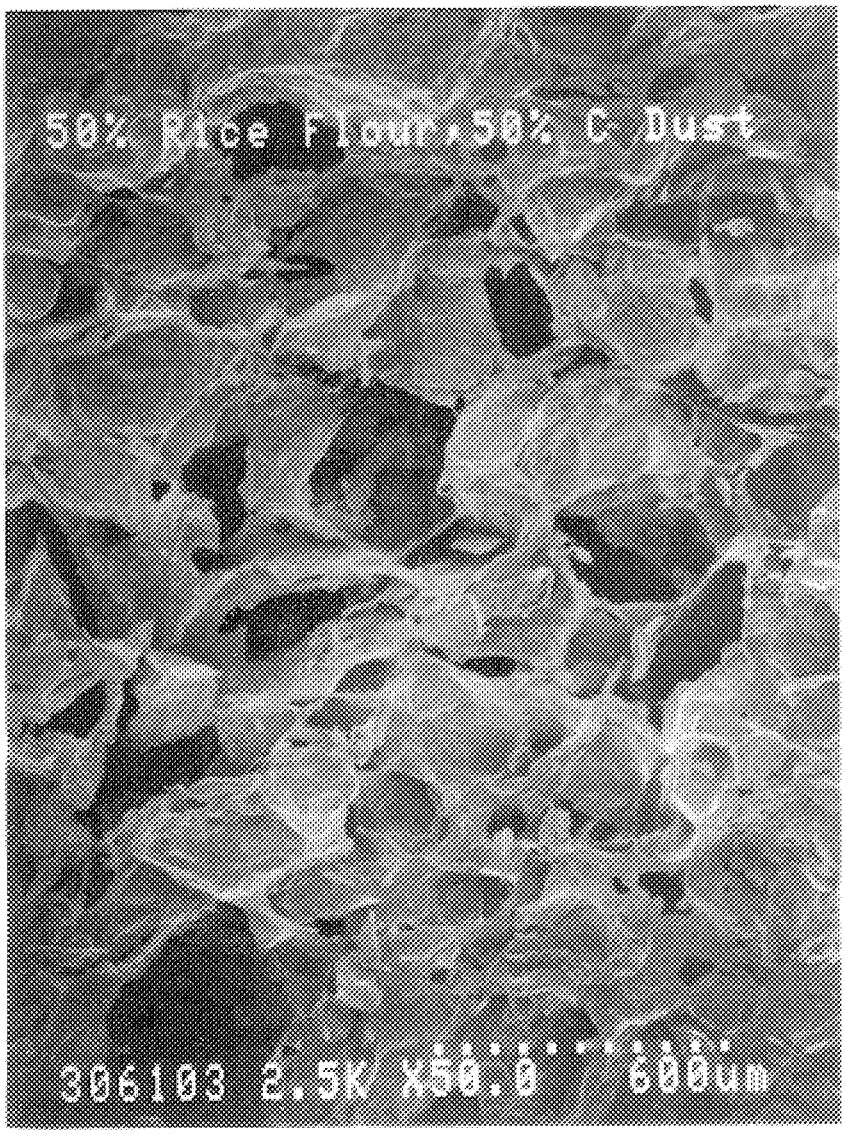
FIGS. 2 and 3 are microphotographs of two different mixtures of the extruded low density tobacco product.
Figure 3:
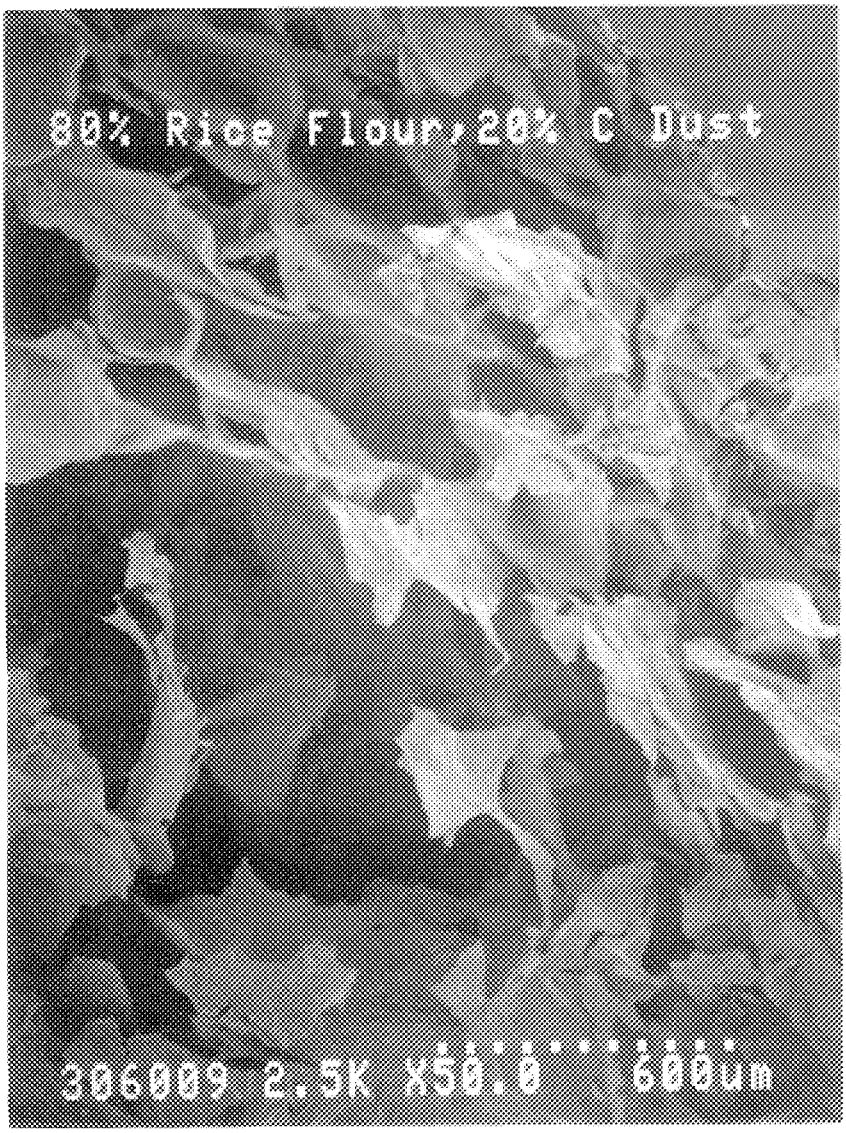

Referring to FIGS. 2 and 3, it can be seen that the void spaces of the FIG. 2 composition of 50% rice flour and 50% C-dust are smaller than the void spaces of the FIG. 3 composition of 80% rice flour and 20% C-dust. The extrudate 18 is then treated at a treatment station 20 at which the extrudate is cut or shredded into cut filler-sized pieces for use as a cigarette filler or as a blend with cut tobacco. If additional coloring is needed to darken the filler material, the extrudate may be toasted in a conventional convection oven. The resulting processed material 22 is ready to be used in lieu of or in addition to cut tobacco filler in cigarettes.

The resulting low density extruded tobacco product can be employed in cigarette manufacture using techniques known in the art. For example, the low density, extruded tobacco product can be further processed, treated with additives, blended with other materials, cut, shredded or otherwise processed to achieve the desired size of 6 to 20 mesh, preferably 10 to 16 mesh. Preferably, the low density extruded tobacco product is used as cut filler or as a tobacco extender in the manufacture of cigarettes. The low density, extruded tobacco product of the invention exhibits excellent smoking properties. The tobacco material useful in this invention can be varied. Typical tobacco material includes, as previously described, tobacco C-dust and fines, and optionally, either whole or ground stems. Other useable tobacco material includes tobacco laminae, tobacco cut filler, volume expanded tobacco, scrap tobacco from various processing and cigarette manufacturing stages, tobacco stalks, scraps and sheets of reconstituted tobacco materials, rolled tobacco stems, tobacco in essentially whole leaf form and the like as well as combinations thereof. The original size of the various pieces and particles is not very critical, but it is preferred that the pieces pass a 10 mesh screen, more preferably, a 20 mesh screen, even more preferably a 30 mesh screen and most preferably a 40 mesh screen. Optionally, tobacco stems can be used in lieu of some of the C-dust or tobacco pieces. The tobacco stems can be used as pieces from ¼ inch to 3 inches long, preferably ¼ inch to 1 inch long even more preferably ¼ inch to ½ inches long or ground to particles in the range described above, preferably particles able to pass a 40 mesh screen.

Tobaccos useful in the invention include Burley, flue cured, Maryland and Oriental tobaccos, as well as mixtures of different tobaccos chosen for the desired pleasurable taste upon smoking. Such tobaccos and mixtures will be apparent to one skilled in the tobacco blending art. If desired, flavorants, casing, humectants, such as glycerine, other top dressing materials, or other flavor enhancing materials can be incorporated into the mixture which is ultimately extruded. The flavor additives can be added at various stages of the process. Such flavor additives may include menthol, licorice, vanillin, cocoa, tobacco aroma oils and sugars, such as fructose, sucrose, dried molasses, flavor precursors, dried herbs, spices, flavorful forages, etc. Fillers and processing agents, such as sodium, potassium and calcium carbonate, sodium and potassium bicarbonate, and activated carbons, are also useful in the composition of the present invention. Such fillers and agents can be added to the mixture of tobacco and starch or flour before the water is added and the tobacco mixture is extruded. In addition, other additives, such as diammonium phosphate and monoammonium phosphate, calcium, sodium or potassium nitrates, can also be used with the tobacco/grain flour or tobacco/starch mixture. The use of organic acid additives and other processing aids is described in U.S. Pat. No. 4,836,224, the disclosure of which is incorporated herein by reference.

The use of expansion agents is also contemplated for use in the invention to expand tobacco/flour or tobacco/starch mixtures that have high densities. A preferred expansion agent will be non-toxic and will expand the tobacco/flour or tobacco/starch mixture in a safe and controlled way. Examples of suitable expansion agents are mixtures of sodium or potassium diphosphate or calcium phosphate with sodium, potassium or calcium carbonate so that the mixtures will generate carbon dioxide when mixed with water and heated in the extrusion process. Another example of an expansion agent is a mixture of succinic or tartaric acid with sodium, potassium or calcium carbonate so that the mixture generates carbon dioxide when mixed with water and heated during the extrusion process. Still another example is the use of "double action" baking powders with the tobacco/starch or tobacco/flour mixtures in the extrusion process.

The grain flour that is mixed with the tobacco can be selected from any available grain flour. The same types of grain flour can also be used for the tobaccoless extruded product. Examples include corn, wheat, milo, rye, oat, barley and other grains as well as potato flour and mixtures of these flours. The grain flour should be bland in taste and not give the cigarette an off-flavor when smoked. The grain flour should also be non-allergenic and safe for human consumption. The preferred grain flour used in the invention is rice flour. Rice flour is extremely bland in taste and essentially non-allergenic making it very acceptable for use in a tobacco product.

The starch used with the tobacco can be any acceptable starch. The same types of starch or mixtures of starches can be used without tobacco as well. Examples include corn starch, potato starch and the like. Rice starch is especially preferred because of its bland taste and aroma when smoked in a tobacco product. Other starches, such as potato and corn starches, can impart an off aroma and/or taste to the tobacco product when smoked.

The composition of the invention may be a mixture of about 50 percent by weight of either starch or grain flour and about 50 percent by weight of tobacco and/or filler, such as calcium carbonate, other agents and additives. A preferred mixture is about 70 percent by weight of either starch or grain flour and about 30 percent by weight of tobacco and/or fillers, agents and additives.

The tobacco and starch or flour should be thoroughly mixed in the mixing chamber 10. If any other additive, expanding agent, filler, flavoring agent or other material is to be extruded with the tobacco and starch or rice flour, it can be added at this point. The moisture content of the mixture at this point should be optimized to provide a dry, free flowing powder that can be readily conveyed to the extruder throat. The mixture is then fed to the extruder throat 12 where water or other plasticizer is added. Sufficient water is added to the tobacco/starch or tobacco/flour mixture to completely moisten it. If any other moistening agent or plasticizer is desired, it can be added at the preconditioner stage. Water mixed with glycerine or propylene glycol can be used as the moistening agent or plasticizer at this stage. The moistened mixture is then fed into the extruder and extruded.

The extrusion process of flour or starch without tobacco is generally the same as the extrusion of the tobacco/starch or tobacco/flour mixtures. The flour or starch can be mixed with any additive, expanding agent, filler, flavoring agent or other material at the mixing chamber stage of the process. Again, the mixture should be optimized to provide a dry, free-flowing powder that can be readily conveyed to the extruder throat. The extrusion and drying processes are again generally the same as for a tobacco/starch or tobacco/flour mixture.

Extruders useful in practicing the invention include both single screw and twin screw extruders. Suitable extruders include commercially available Wenger TX-52, TX-80 and TX-138 extruders as well as extruders commercially available from Brabender, Werner and Pfleiderer and Baker-Perkins. A preferred extruder is a "cooker" extruder with a thermal jacket for heating or cooling the material during processing. The extruder can be employed with various screw configurations known in the art. For example, screws having combinations of feeder elements, mixing elements, shearing elements and shear locks can be selected as desired to obtain optimum extrusion results.

The moistened tobacco/starch or tobacco/grain flour mixture is subjected to extrusion conditions which can vary, but generally involve a mixing of the material at temperatures above ambient temperature within the barrel of the extruder followed by forcing the mixture through the die orifice of the extruder. For example, when a tobacco/starch mixture is extruded, the barrel temperature adjacent the extruder die ranges between about 80° C. to 125° C., and the extruder pressure at the outlet die is between about 2000 kPa to about 5000 kPa, preferably 2500 to 4500 kPa. For mixtures of tobacco and rice flour, the temperature and pressure at the barrel adjacent the extruder die range from about 105° C. to 175° C. and 1250 kPa to 5650 kPa, respectively, and preferably 125° C. to 165° C. and 3400 kPa to 4480 kPa, respectively. Those combinations of temperature and pressure are such that the water remains in the liquid phase within the extruder but flashes into steam when the mixture is extruded through the die thereby forming a closed cell structure within the extruded material. This closed cell structure can be easily seen in either FIG. 2 or FIG. 3. The die can be any conventional die and the cross-sectional shape of the die should be such that the extrudate can be easily treated or cut. As previously mentioned, the size of the die orifice will influence the density of the extrudate at constant temperature and pressure. Lower density extrudate is obtained when a larger die orifice is used.

The moisture content of the tobacco/starch or tobacco/grain flour mixture can vary during extrusion conditions. The mixture should have a semi-soft, plastic consistency suitable for extruding. Typically, a tobacco/starch or a tobacco/rice flour mixture will have a moisture content of 9–12% wet basis (wb), preferably 9.5–11% wb and more preferably about 10% wb. Since a tobacco/rice flour mixture has an inherent moisture content of about 8.4% wb, additional water is added to the extruder.

The residence time of the tobacco/starch or tobacco/grain flour mixture in the extruder apparatus can vary depending on the speed of the extruding screw, length of the extrusion barrel and the temperature of the mixture that is desired. In general, a time period sufficient to gelatinize the starch at the temperature at which the extrusion is carried out at the desired temperature is preferred. In addition, the time period should be sufficient to adequately mix and shear the moist mixture in the barrel of the extruder. A flour or starch mixture or tobacco/starch, tobacco/flour mixture that does not have an acceptable color can be sprinkled with finely ground tobacco dust, tobacco dust extract or can be dyed or toasted after extrusion and before being dried or after cutting the extrudate into cigarette filler so that the extruded product will have a color and appearance appropriate for use as a cigarette filler.

After the material has been extruded and the extruded mass has expanded, the material is dried in an oven. The preferred oven is a multi-stage oven with independent temperature control of the stages and forced draft. The temperature of the first stage should be from about 105° C. to 145° C., preferably 110° C. to 135° C., more preferably 115° C. to 125° C., and even more preferably 120° C. The temperature of the second stage should be between ambient temperature and 50° C. preferably 38° C. to 40° C. and the temperature of the third stage should be between ambient and 45° C. preferably 35°–37° C.

The moisture content of the extruder discharge can vary depending on the discharge conditions. Generally, the moisture content will vary from 8% to 17% wb on discharge from the extruder. After the extrudate is dried, the moisture content will depend on whether the extruded material is to be cut into pieces the size of cut tobacco filler or whether the extruded material is to be transported or stored. The extrudate material is usually fed into the drying oven, as has been described, and dried to a moisture content of 4.8 to 8.5% wb, preferably 5.3 to 8.3% wb for transportation and storage. The bed depth in the oven is about 2.54 cm, and the retention time in the oven is about 1.4 minutes per pass. It is to be understood that the bed depth, retention time and oven temperature can be varied depending on the moisture content of the starting materials and the desired moisture content after drying. The preferred moisture content after drying will depend on how the extruded mixture is to be used. For example, if the extruded mixture is to be used as cut filler in cigarettes, the moisture content will be optimized for the efficient cutting of the extrudate. If the extruded mixture is to be shipped, it should be dried to a moisture content that prevents molding of the mixture.

If, after drying, the tobacco/starch mixture, tobacco/flour mixture, and especially the extruded starch or flour mixtures without tobacco, does not have the proper tobacco color and appearance, the mixture can be toasted in a convection oven to achieve a tobacco-like color and appearance.

The following examples are provided in order to further illustrate various embodiments of the invention but should not be construed as limiting the scope thereof. Unless otherwise noted, all parts and percentages are by wet weight percent or wet basis (wb).

EXAMPLE 1

Extrusion of a 10% tobacco 90% rice flour mixture was accomplished as follows:

One part tobacco in the form of C-dust was thoroughly mixed with nine parts of BB-100 Rivland rice flour before being fed into the preconditioner. The dry mixture had a moisture content of 8.41% wb. In general, the dry mixture was fed to the extruder inlet, where water was added to the dry mixture. The extruder shaft speed will determine the temperature of the tobacco/rice flour mixture, since the mixture is heated by friction. The extruder shaft speed will also determine the pressure at the extruder head, since this pressure is a function of the temperature and viscosity of the mixture.

The following table describes two different extrusion runs using the 10% tobacco 90% rice flour mixture:

TABLE 1

| | Run 1 | Run 2 |
|---|---|---|
| Moisture content of mixture entering the extruder (% wb) | 10.69 | 10.71 |
| Extruder shaft speed (rpm) | 420 | 500 |
| Water flow to extruder (kg/hr) | 45 | 28 |
| Temperature at 3rd head °C. | 62 | 36 |
| Temperature at 4th head °C. | 62 | 60 |
| Temperature at 5th head °C. | 108 | 156 |
| Temperature at 6th head °C. | 126 | 156 |
| Pressure at 6th head (kPa) | 3450 | 4480 |
| Extruder discharge moisture content (% wb) | 13.37 | 9.66 |
| Extruder discharge density (lb/ft$^3$) | 11 | 6 |
| Dryer discharge moisture content (% wb) | 11.01 | 5.88 |

The extruded material can then be dried in a drying oven. The first zone of the oven is maintained at 120° C., the second zone is maintained at about 38° C., and the third zone is maintained at a temperature of about 36° C. The drying bed depth was maintained at 2.54 cm, and the material was passed twice through the dryer, with a retention time of 1.4 minutes per pass with a final moisture content as indicated above as "Dryer discharge moisture content."

The extruded material, after drying, is ready for further processing to form a cut filler substitute.

EXAMPLE 2

Extrusion of a 20% tobacco 80% rice flour mixture was accomplished as follows with the procedure being generally the same as in Example 1. The following table describes three different extrusion runs using the aforesaid 20% tobacco 80% rice flour mixture.

TABLE 2

| | Run 1 | Run 2 | Run 3 |
|---|---|---|---|
| Moisture content of mixture entering the extruder (% wb) | 10 | 10.99 | — |
| Extruder shaft speed (rpm) | 500 | 500 | 500 |
| Water flow to extruder (kg/hr) | 28 | 36 | 25 |
| Temperature at 3rd head °C. | 32 | 32 | 50 |
| Temperature at 4th head °C. | 48 | 47 | 50 |
| Temperature at 5th head °C. | 166 | 151 | 50 |
| Temperature at 6th head °C. | 160 | 161 | 151 |
| Temperature at 7th head °C. | — | — | 122 |

TABLE 2-continued

| | Run 1 | Run 2 | Run 3 |
|---|---|---|---|
| Pressure at 6th head (kPa) | 4140 | 3790 | — |
| Pressure at 7th head (kPa) | — | — | 4830 |
| Extruder discharge moisture content (% wb) | 9.44 | 12.13 | — |
| Extruder discharge density (lb/ft$^3$) | 6 | 9 | 3.5 |
| Dryer discharge moisture content (% wb) | 5.53 | 7.57 | — |
| Dryer discharge density (lb/ft$^3$) | — | — | 5.0 |
| Density after shipping (lb/ft$^3$) | — | — | 5.0 |
| Moisture content after shipping (% wb) | — | — | 7.0 |

EXAMPLE 3

Extrusion of a 30% tobacco 70% rice flour mixture was accomplished as follows, with the procedure being generally the same as in Example 1. The following table describes an extrusion run using the aforesaid 70% flour, 30% tobacco composition.

TABLE 3

| | |
|---|---|
| Extruder shaft speed (rpm) | 490 |
| Water flow to extruder (kg/hr) | 20 |
| Temperature at 3rd head °C. | 50 |
| Temperature at 4th head °C. | 50 |
| Temperature at 5th head °C. | 50 |
| Temperature at 6th head °C. | 120 |
| Temperature at 7th head °C. | 110 |
| Pressure at 7th head (kPa) | 5170 |
| Extruder discharge density (lb/ft$^3$) | 3.4 |
| Dryer discharge density (lb/ft$^3$) | 3 |
| Density after shipping (lb/ft$^3$) | 4.8 |
| Moisture content after shipping (% wb) | 6.5 |

EXAMPLE 4

Extrusion of a 40% tobacco 60% rice flour mixture was accomplished as follows with the procedure being generally the same as in Example 1. The following table describes two different extrusion runs using the aforesaid 40% tobacco 60% rice flour mixture.

TABLE 4

| | Run 1 | Run 2 |
|---|---|---|
| Moisture content of mixture entering the extruder (% wb) | 10.61 | 10.29 |
| Extruder shaft speed (rpm) | 500 | 500 |
| Water flow to extruder (kg/hr) | 36 | 20 |
| Temperature at 3rd head °C. | 34 | 31 |
| Temperature at 4th head °C. | 47 | 42 |
| Temperature at 5th head °C. | 153 | 165 |
| Temperature at 6th head °C. | 157 | 163 |
| Pressure at 6th head (kPa) | 3450 | 3790 |
| Extruder discharge moisture content (% wb) | 12.65 | 8.58 |
| Extruder discharge density (lb/ft$^3$) | 8.5 | 6.6 |
| Dryer discharge moisture content (% wb) | 6.62 | 5.33 |

EXAMPLE 5

Extrusion of a 50% tobacco 50% rice flour mixture was accomplished as follows with the procedure being generally the same as in Example 1. The following table describes four different extrusion runs using the aforesaid 50% tobacco 50% rice flour mixture.

TABLE 5

| | Run 1 | Run 2 | Run 3 | Run 4 |
|---|---|---|---|---|
| Moisture content of mixture entering the extruder (% wb) | 10.4 | 10.4 | — | — |
| Extruder shaft speed (rpm) | 500 | 500 | 488 | 500 |
| Water flow to extruder (kg/hr) | 20 | 36 | 18 | 25 |
| Temperature at 3rd head °C. | 31 | 40 | 50 | 50 |
| Temperature at 4th head °C. | 40 | 41 | 50 | 50 |
| Temperature at 5th head °C. | 166 | 133 | 50 | 50 |
| Temperature at 6th head °C. | 165 | 149 | 152 | 132 |
| Temperature at 7th head °C. | — | — | 119 | 114 |
| Pressure at 6th head (kPa) | 3450 | 70 | — | — |
| Pressure at 7th head (kPa) | — | — | 3450 | 3900 |
| Extruder discharge moisture content (% wb) | 8.69 | 6.89 | — | — |
| Extruder discharge density (lb/ft$^3$) | 7.6 | 16.6 | 8.1 | 6 |
| Dryer discharge moisture content (% wb) | 5.35 | 11.8 | — | — |
| Dryer discharge density (lb/ft$^3$) | — | — | 8 | 8 |
| Density after shipping (lb/ft$^3$) | — | — | 10.4 | 9.2 |
| Moisture content after shipping (% wb) | — | — | 6.3 | 5 |

EXAMPLE 6

Extrusion of a 55% tobacco, 45% rice flour mixture was accomplished as follows, with the procedure being generally the same as in Example 1. The following table describes two different extrusion runs using the aforesaid 55% tobacco, 40% rice flour mixture.

TABLE 6

| | Run 1 | Run 2 |
|---|---|---|
| Extruder shaft speed (rpm) | 500 | 500 |
| Water flow to extruder (kg/hr) | 20 | 25 |
| Temperature at 3rd head °C. | 60 | 60 |
| Temperature at 4th head °C. | 50 | 50 |
| Temperature at 5th head °C. | 50 | 50 |
| Temperature at 6th head °C. | 142 | 142 |
| Temperature at 7th head °C. | 100 | 100 |
| Pressure at 7th head (kPa) | 4140 | 3450 |
| Extruder discharge density (lb/ft$^3$) | 11.5 | 11.3 |
| Dryer discharge density (lb/ft$^3$) | 11.0 | 10.5 |
| Density after shipping (lb/ft$^3$) | 12.5 | 11.3 |
| Moisture content after shipping (% wb) | 6.2 | 6.1 |

EXAMPLE 7

Extrusion of a 60% tobacco, 40% rice flour mixture was accomplished as follows with the procedure being generally the same as in Example 1. The following table describes two different extrusion runs using the aforesaid 60% tobacco 40% rice flour mixture.

TABLE 7

| | Run 1 | Run 2 |
|---|---|---|
| Moisture content of mixture entering the extruder (% wb) | 9.62 | — |
| Extruder shaft speed (rpm) | 500 | 500 |
| Water flow to extruder (kg/hr) | 25 | 35 |
| Temperature at 3rd head °C. | 50 | 50 |
| Temperature at 4th head °C. | 31 | 36 |
| Temperature at 5th head °C. | 84 | 104 |
| Temperature at 6th head °C. | 100 | 95 |
| Pressure at 7th head (kPa) | 1380 | 2760 |
| Extruder discharge moisture content (% wb) | 11.57 | — |
| Extruder discharge density (lb/ft$^3$) | 10.5 | 10.0 |
| Moisture content at density shown below (% wb) | 6.5 | 4.7 |
| Density after shipping (lb/ft$^3$) | 12.8 | 12.6 |

EXAMPLE 8

Extrusion of a 80% tobacco 20% rice flour mixture was accomplished as follows with the procedure being generally as follows. The following table describes four different extrusion runs using the aforesaid 80% tobacco 20% rice flour mixture.

TABLE 8

| | Run 1 | Run 2 | Run 3 | Run 4 |
|---|---|---|---|---|
| Moisture content of mixture entering the extruder (% wb) | 10.33 | 9.43 | — | — |
| Extruder shaft speed (rpm) | 500 | 422 | 420 | 485 |
| Water flow to extruder (kg/hr) | 32 | 30 | 10 | 15 |
| Temperature at 3rd head °C. | 44 | 50 | 50 | 50 |
| Temperature at 4th head °C. | 59 | 38 | 35 | 32 |
| Temperature at 5th head °C. | 148 | 91 | 106 | 84 |
| Temperature at 6th head °C. | 152 | 99 | 94 | 104 |
| Pressure at 6th head (kPa) | 70 | — | — | — |
| Pressure at 7th head (kPa) | — | 3450 | 3450 | 3450 |
| Extruder discharge moisture content (% wb) | 15.86 | 9.73 | — | — |
| Extruder discharge density (lb/ft$^3$) | 17 | 12.5 | 14.5 | 7.5 |
| Dryer discharge moisture content (% wb) | 8.03 | — | — | — |
| Moisture content at density shown below (% wb) | — | 3.9 | 4.9 | 5.1 |
| Density after shipping (lb/ft$^3$) | — | 13.8 | 14.2 | 13.4 |

EXAMPLE 9

Extrusion of a 10% tobacco, 10% extract, 80% rice flour mixture was accomplished as follows, with the procedure being generally as follows. The following table describes an extrusion run using the aforesaid 10% tobacco, 10% extract and 80% rice flour mixture. The extract is a powder obtained from a water-based extract of C-dust that is prepared by the method described in Example 1 of U.S. Pat. No. 5,121,757, the disclosure of which is incorporated herein by reference.

TABLE 9

| | |
|---|---|
| Extruder shaft speed (rpm) | 500 |
| Water flow to extruder (kg/hr) | 23 |
| Temperature at 3rd head °C. | 43 |
| Temperature at 4th head °C. | 50 |
| Temperature at 5th head °C. | 50 |
| Temperature at 6th head °C. | 135 |
| Temperature at 7th head °C. | 115 |
| Pressure at 7th head (kPa) | 3800 |
| Extruder discharge density (lb/ft$^3$) | 4.2 |
| Dryer discharge density (lb/ft$^3$) | 3 |
| Density after shipping (lb/ft$^3$) | 4.6 |
| Moisture content after shipping (% wb) | 6.6 |

EXAMPLE 10

Extrusion of a 60% tobacco, 40% rice starch mixture was accomplished as follows:

Six parts tobacco in the form of C-dust was mixed with four parts of rice starch before being fed into the preconditioner. The mixture of starch and tobacco should have a free flowing, powdery consistency. The dry mixture was then fed into the extruder inlet, where water was added to the dry mixture. The rate of flow of the starch-tobacco mixture into the extruder, the extruder shaft speed and the viscosity of the mixture help determine the temperature during the extrusion process, since the mixture is heated by friction. The mixture was heated to a temperature where the starch was gelatinized during the extrusion process. The pressure at the extruder head is a function of the extruder shaft speed, temperature and viscosity of the mixture as well. In general, the extruder head pressure and temperature should be such that the water remains in liquid form inside the extruder but flashes into steam when the mixture is extruded and the pressure is relieved.

The following table describes an extrusion run using a 60% tobacco, 40% rice starch mixture:

TABLE 10

| | |
|---|---|
| Extruder shaft speed (rpm) | 490 |
| Water flow to extruder (kg/hr) | 29 |
| Temperature at 3rd head °C. | 49 |
| Temperature at 4th head °C. | 52 |
| Temperature at 5th head °C. | 104 |
| Temperature at 6th head °C. | 100 |
| Pressure at 7th head (kPa) | 3790 |
| Extruder discharge density (lb/ft$^3$) | 8.5 |
| Moisture content at density shown below (% wb) | 6.6 |
| Density after shipping (lb/ft$^3$) | 11.3 |

EXAMPLE 11

A mixture of 40% rice flour, 50% tobacco, and 10% calcium carbonate was prepared and extruded. The calcium carbonate was a dense precipitate designated "heavy" from Specialty Mineral Inc., Adams, Massachusetts. The method of preparation and extrusion was generally the same as was disclosed in Examples 1 and 10. The following table describes the extrusion runs using the aforesaid rice flour/tobacco/calcium carbonate mixture.

TABLE 11

| | |
|---|---|
| Extruder shaft speed (rpm) | 596 |
| Water flow to extruder (kg/hr) | 22 |
| Temperature at 3rd head °C. | 50 |
| Temperature at 4th head °C. | 50 |
| Temperature at 5th head °C. | 50 |
| Temperature at 6th head °C. | 145 |
| Temperature at 7th head °C. | 112 |
| Pressure at 7th head (kPa) | 3450 |
| Extruder discharge density (lb/ft$^3$) | 6 |
| Density after shipping (lb/ft$^3$) | 5.8 |
| Moisture content after shipping (% wb) | 13.5 |

EXAMPLE 12

A mixture of 70% rice flour, 20% tobacco and 10% calcium carbonate was prepared and extruded. The calcium carbonate was designated heavy in Run 1 and a calcium carbonate designated as extra-light was used in Run 2. The method of extrusion was generally the same as in Examples 1 and 10. The following table describes the two extrusion runs using the aforesaid rice flour/tobacco/calcium carbonate mixture.

TABLE 12

| | Run 1 | Run 2 |
|---|---|---|
| Extruder shaft speed (rpm) | 475 | 492 |
| Water flow to extruder (kg/hr) | 23 | 30 |
| Temperature at 3rd head °C. | 50 | 50 |
| Temperature at 4th head °C. | 55 | 50 |
| Temperature at 5th head °C. | 40 | 50 |
| Temperature at 6th head °C. | 150 | 121 |
| Temperature at 7th head °C. | 113 | 110 |
| Pressure at 7th head (kPa) | 4830 | 4830 |
| Extruder discharge density (lb/ft$^3$) | 2 | 3 |
| Dryer discharge density (lb/ft$^3$) | 3 | 3 |
| Density after shipping (lb/ft$^3$) | 4.3 | 4.4 |
| Moisture content after shipping (% wb) | 6.8 | 7.3 |

EXAMPLE 13

A mixture of 70% rice flour, 10% tobacco and 20% calcium carbonate was prepared and extruded. The calcium carbonate was designated heavy. The method of extrusion was generally the same as was disclosed in Examples 1 and 10. The following table describes two extrusion runs using the aforesaid rice flour/tobacco/calcium carbonate mixture.

TABLE 13

| | Run 1 | Run 2 |
|---|---|---|
| Extruder shaft speed (rpm) | 480 | 490 |
| Water flow to extruder (kg/hr) | 30 | 30 |
| Temperature at 3rd head °C. | 50 | 50 |
| Temperature at 4th head °C. | 50 | 50 |
| Temperature at 5th head °C. | 50 | 50 |
| Temperature at 6th head °C. | 135 | 131 |
| Temperature at 7th head °C. | 113 | 109 |
| Pressure at 7th head (kPa) | 4140 | 5170 |
| Extruder discharge density (lb/ft$^3$) | 1 | 2 |
| Dryer discharge density (lb/ft$^3$) | 2 | 2 |
| Density after shipping (lb/ft$^3$) | 3.4 | 4.4 |
| Moisture after shipping (% wb) | 6.8 | 7.3 |

EXAMPLE 14

A mixture of 70% rice flour, 5% tobacco and 25% calcium carbonate was prepared and extruded. The method of extrusion was generally the same as was disclosed in Examples 1 and 10. The following table describes an extrusion run using the aforesaid rice flour/tobacco/calcium carbonate mixture.

TABLE 14

| | |
|---|---|
| Extruder shaft speed (rpm) | 492 |
| Water flow to extruder (kg/hr) | 30 |
| Temperature at 3rd head °C. | 50 |
| Temperature at 4th head °C. | 50 |
| Temperature at 5th head °C. | 50 |
| Temperature at 6th head °C. | 137 |
| Temperature at 7th head °C. | 110 |
| Pressure at 7th head (kPa) | 3480 |
| Extruder discharge density (lb/ft$^3$) | 3 |
| Dryer discharge density (lb/ft$^3$) | 4.2 |
| Density after shipping (lb/ft$^3$) | 5.5 |
| Moisture content after shipping (% wb) | 7.7 |

EXAMPLE 15

A mixture of 70% rice flour and 30% calcium carbonate was prepared and extruded. The calcium carbonate was designated heavy for Runs 1 and 3 and a less dense calcium carbonate designated as extra-light was used in Run 2. The method of extrusion was generally the same as was disclosed in Examples 1 and 10. The following table describes the extrusion runs using the aforesaid rice flour/calcium carbonate mixture.

TABLE 15

| | Run 1 | Run 2 | Run 3 |
|---|---|---|---|
| Extruder shaft speed (rpm) | 491 | 492 | 490 |
| Water flow to extruder (kg/hr) | 37 | 30 | 40 |
| Temperature at 3rd head °C. | 50 | 50 | 50 |
| Temperature at 4th head °C. | 50 | 50 | 50 |
| Temperature at 5th head °C. | 50 | 50 | 50 |
| Temperature at 6th head °C. | 123 | 110 | 120 |
| Temperature at 7th head °C. | 106 | 111 | 110 |
| Pressure at 7th head (kPa) | 4140 | 3430 | 4140 |
| Extruder discharge density (lb/ft$^3$) | 1.4 | 1.1 | 1 |
| Dryer discharge density (lb/ft$^3$) | 2 | 3.4 | 2 |
| Density after shipping (lb/ft$^3$) | 3.4 | 5 | — |
| Moisture content after shipping (% wb) | 7.1 | 6.6 | — |

EXAMPLE 16

A mixture of 70% rice flour, 7% tobacco, 20% calcium carbonate and 3% diammonium phosphate was prepared and extruded. The calcium carbonate was designated heavy. The method of extrusion was generally the same as was disclosed in Examples 1 and 10. The following table describes an extrusion run using the aforesaid rice flour/tobacco/calcium carbonate mixture.

TABLE 16

| | |
|---|---|
| Extruder shaft speed (rpm) | 492 |
| Water flow to extruder (kg/hr) | 35 |
| Temperature at 3rd head °C. | 50 |
| Temperature at 4th head °C. | 50 |
| Temperature at 5th head °C. | 50 |
| Temperature at 6th head °C. | 122 |
| Temperature at 7th head °C. | 110 |
| Pressure at 7th head (kPa) | 4830 |
| Extruder discharge density (lb/ft$^3$) | 2.2 |
| Dryer discharge density (lb/ft$^3$) | 5 |

TABLE 16-continued

| | |
|---|---|
| Density after shipping (lb/ft$^3$) | 6.4 |
| Moisture content after shipping (% wb) | 7.4 |

EXAMPLE 17

A mixture of 60% rice flour and 40% calcium carbonate was prepared and extruded. The calcium carbonate was designated heavy. The method of extrusion was generally the same as the method used in Examples 1 and 10. The following table describes an extrusion run using the aforesaid rice flour and calcium carbonate mixture.

TABLE 17

| | |
|---|---|
| Extruder shaft speed (rpm) | 490 |
| Water flow to extruder (kg/hr) | 40 |
| Temperature at 3rd head °C. | 50 |
| Temperature at 4th head °C. | 45 |
| Temperature at 5th head °C. | 115 |
| Temperature at 6th head °C. | 97 |
| Pressure at 7th head (kPa) | 5520 |
| Extruder discharge moisture content (% wb) | — |
| Moisture content at density shown below (% wb) | 5.7 |
| Density after shipping (lb/ft$^3$) | 3.4 |

EXAMPLE 18

Cigarettes incorporating varying amounts of the starch/$CaCO_3$ filler, rice flour/tobacco or rice flour/$CaCO_3$/tobacco fillers are provided using the following procedure. Detailed descriptions of cigarette manufacture are described in U.S. Pat. No. 4,836,224.

Cigarettes were made having a length of 84 mm and a circumference of about 24.85 mm and a filter element of 27 mm. The tobacco rod includes a charge of cut finer and artificial filler weighing about 465 mg contained in a circumscribing known cigarette wrap that is sold commercially as Reference 456 purchased from Ecusta Corporation, Pisgah Forest, N.C. The filter element is manufactured by Baumgartner of Mebane, N.C. The filter element is a two piece carbonpaper filter/cellulose acetate filter as described in U.S. Pat. No. 3,360,023, the disclosure of which is incorporated herein by reference. The carbon paper filter segment is 10 mm in length. The cellulose acetate segment (closest to the mouth end of the cigarette) is 17 mm in length. The overall 27 mm tip draft for the filter was 85 mm of $H_2O$. The filter element was manufactured using conventional plug tube technologies employing non-air permeable paper plug wrappers. The tobacco rod and filter element are aligned in an abutting, end-to-end relationship and secured together using a non-air permeable tipping paper. The tipping material circumscribes the length of the filter element and about 3 mm of the length of the tobacco rod. Cigarettes so described are manufactured using a Pilot Cigarette Maker from Hauni-Werke Korber & Co. KG.

The filler material employed in providing the tobacco rod is in the form of strands cut at about 32 cuts per inch. The cut filler includes about 43% flue cured tobacco, of which about 50% is volume expanded employing the dry-ice expanded tobacco (DIET) method, 17% oriental tobacco and 40% of an extruded material containing 60% rice flour and 40% precipitated $CaCO_3$. The calcium carbonate so precipitated, is designated as "heavy" and was purchased from Specialty Mineral Inc., Adams, Mass. The rice flour was purchased from Riviana Food Inc. as type RL-100. This extruded material is described in Example 17 above. The extruded material was moisturized in an humidification chamber to a moisture of about 10–12% and was sliced into cut-filler form. The tobacco portion of the blend was moisturized and cut into cut filler form and blended with the extruded material. An aqueous solution of diammonium phosphate (DAP) was sprayed onto the cut-filler blend. The final concentration of DAP on the total blend was about 3%. This blend was used to prepare the cigarettes of this example.

Cigarettes prepared from Example 18 were smoked under controlled conditions. The example cigarette gave 7.7 puffs, exhibited good burning characteristics and had an acceptable tobacco taste and flavor when compared with Camel Lights 85.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A low density, binderless extruded tobacco composition comprising tobacco and grain flour, said low density, binderless extruded tobacco composition having a density lass than 10 lb/ft$^3$.

2. The low density extruded tobacco composition of claim 1, wherein the composition density is less than about 5 lb/ft$^3$.

3. The low density extruded tobacco composition of claim 1, wherein the composition density is less than about 3 lb/ft$^3$.

4. The extruded material of claim 1, wherein the grain flour is selected from the group consisting of wheat, oat, corn, barley, rye, milo, potato and rice flour.

5. The extruded material of claim 4 wherein the grain flour is rice flour.

6. The extruded material of claim 5 wherein a filler material is added to the rice flour.

7. The extruded material of claim 6 wherein the filler material is selected from the group consisting of sodium bicarbonate, potassium bicarbonate, sodium carbonate, potassium carbonate, calcium carbonate and activated carbon.

8. The extruded material of claim 1, including diammonium phosphate.

9. A smokable article comprising cut tobacco and a shredded, low density, binderless extruded tobacco composition comprising tobacco and grain flour, said low density tobacco composition having a density less than about 10 lb/ft$^3$.

10. A method of making an extruded tobacco composition comprising:

dry mixing tobacco particles and grain flour together without a binder to form a binderless tobacco/grain flour mixture;

feeding said tobacco/grain flour mixture to the feed port of an extruder;

injecting a moisturizing amount of solvent into the tobacco/grain flour mixture in the feed port of said extruder; and extruding the tobacco/grain flour mixture from the extruder under temperature and pressure conditions such that the solvent flashes into vapor and expands the extruded tobacco/grain flour mixture to form the low density extruded tobacco composition.

11. The method of claim 10, wherein the solvent is water.

12. A low density extruded substitute material for cut tobacco filler in cigarettes comprising shredded extruded starch extruded without a binder and without tobacco particles.

13. The extruded material of claim 12 wherein the starch is selected from the group consisting of corn, wheat, potato and rice starch.

14. A smokable article comprising cut tobacco and a shredded low density, binderless extruded material consisting essentially of extruded grain flour, filler and flavorant, said low density extruded material having a density less than 18 lb/ft$^3$.

15. The smokeable article of claim 14, wherein the filler is selected from the group consisting of sodium bicarbonate, potassium bicarbonate, sodium carbonate, potassium carbonate, calcium carbonate and activated carbon.

16. The smokeable article of claim 14, wherein the flavorant is selected from the group consisting of menthol, licorice, vanillin, cocoa, herbs, spices, flavorful forages, tobacco aroma oils, molasses and sugars.

* * * * *